US005537931A

United States Patent [19]

Donkin

[11] Patent Number: 5,537,931

[45] Date of Patent: Jul. 23, 1996

[54] BOGIE ADAPTER FOR INTERMODAL TRAILER

[75] Inventor: Thomas G. Donkin, West Lafayette, Ind.

[73] Assignee: Wabash National Corporation, Lafayette, Ind.

[21] Appl. No.: 425,889

[22] Filed: Apr. 21, 1995

[51] Int. Cl.[6] ..... B61F 13/00

[52] U.S. Cl. ..... 105/159; 105/4.2; 410/53

[58] Field of Search ..... 105/4.3, 159, 215.2, 105/198.1, 4.2; 410/53, 56

[56] References Cited

U.S. PATENT DOCUMENTS

| | | | |
|---|---|---|---|
| 3,317,219 | 5/1967 | Hindin et al. | 410/53 |
| 3,774,550 | 11/1973 | Lich | 105/198.1 X |
| 4,202,454 | 5/1980 | Browne et al. | 105/215.2 X |
| 4,669,391 | 6/1987 | Wicks et al. . | |
| 4,766,818 | 8/1988 | Wicks et al. | 105/4.3 |
| 4,841,872 | 6/1989 | Wicks et al. . | |
| 4,907,514 | 3/1990 | Wicks et al. . | |
| 4,955,292 | 9/1990 | Cripe . | |
| 4,961,676 | 10/1990 | Gourdin | 410/53 |
| 5,040,466 | 8/1991 | Wicks et al. . | |
| 5,107,772 | 4/1992 | Viens | 105/159 |
| 5,291,835 | 3/1994 | Wicks | 105/159 X |
| 5,297,858 | 3/1994 | Zupan | 105/159 X |

FOREIGN PATENT DOCUMENTS

| | | |
|---|---|---|
| 2168020 | 1/1989 | United Kingdom . |

*Primary Examiner*—Lee Young
*Assistant Examiner*—Kevin D. Rutherford
*Attorney, Agent, or Firm*—Trexler, Bushnell, Giangiorgi & Blackstone, Ltd.

[57] ABSTRACT

There is disclosed a rail bogie for connection with an intermodal or rail highway trailer having conventional highway wheels. The rail bogie includes an adapter engageable with a trailer and incorporating a lift mechanism for enabling the adapter to be lowered or collapsed for insertion beneath a trailer, and to be lifted or extended for raising the trailer and lifting the trailer wheels off of the ground.

24 Claims, 13 Drawing Sheets

BOGIE ADAPTER FOR INTERMODAL TRAILER

BACKGROUND OF THE INVENTION

The present invention relates to a novel rail truck having an adapter for an intermodal trailer, and more specifically, to a novel adapter assembly on a rail truck connectable with an intermodal trailer constructed for over the highway use or, alternatively, for rail transportation.

Various proposals have heretofore been made for constructing intermodal trailers capable of highway or rail use. In general, such proposals have contemplated trailers having highway wheel assemblies, and either rail wheel assemblies or means for connection to a separate rail truck. One such proposal is disclosed in Wicks et al. U.S. Pat. No. 5,040,466, now assigned to the Assignee of the present invention.

In intermodal trailers of the type contemplated herein previously proposed, it has been necessary to provide some means on the trailer for either relatively extending and retracting the highway wheels and the rail wheels when the rail wheels are on the trailer for alternative highway and rail use, or extending and retracting the highway wheels when a separate rail truck is to be used. In both situations, there is a resultant significant increase in cost and weight of the trailer, as compared with standard highway trailers. The increased weight will, of course, reduce the permissible payload which may be carried by the trailer, which, coupled with the increased costs, reduces the economic benefits which may be expected by the users of an intermodal system.

OBJECTS AND SUMMARY OF THE INVENTION

It is an object of the present invention to provide a novel intermodal, or highway-rail apparatus or system, constructed so as to enable trailers to be raised and lowered for engaging and disengaging their wheels from the ground without the need for any lifting means on the trailer itself.

A more specific object of the present invention is to provide a novel rail truck, including a trailer engageable adapter means constructed for connection with a highway trailer while the trailer has its highway wheels engaging the ground or other support surface, and for subsequently raising the trailer for disengaging the highway wheels from the ground.

A still further object of the present invention is to provide a novel adapter for a rail truck of the above-described type, which is extendable between a retracted condition and an extended condition, respectively, for insertion beneath and connection with, a highway trailer, and for subsequently raising the trailer so as to lift the trailer wheels above the ground.

Another object of the present invention is to provide a novel rail truck and intermodal adapter of the above-described type, including an air system connectable with a conventional air brake of the rail truck, and further including means operable by auxiliary air for manipulating the adapter between retracted and extended conditions.

A further object of the present invention is to provide a novel intermodal adapter for a rail truck of the above-described type, which may be easily and securely interconnected with an intermodal highway trailer.

Another object of the present invention is to provide a novel adapter of the above-described type constructed so as to be securely locked in its extended condition, whereby to preclude any possibility of unintentional collapsing of the adapter, such as during transport over the rail lines.

Other objects and advantages of the present invention will become apparent from the following description and the accompanying drawings.

A rail truck and intermodal adapter constructed in accordance with the present invention generally comprises a four-wheel bogie, including a bolster presenting a centrally located bowl for supporting an adapter. The adapter includes a lower adapter assembly swivelly mounted on the bowl, an intermediate adapter assembly connected by linkage to the lower assembly for movement between collapsed and raised positions. Lifting means, which, in the preferred form, comprises air bags, is provided for raising the intermediate adapter assembly from the lowered or collapsed position to the raised or extended position. An upper adapter assembly is carried by the intermediate assembly, and carries with it means for connection to the highway trailer.

DETAILED DESCRIPTION

Figure 1:
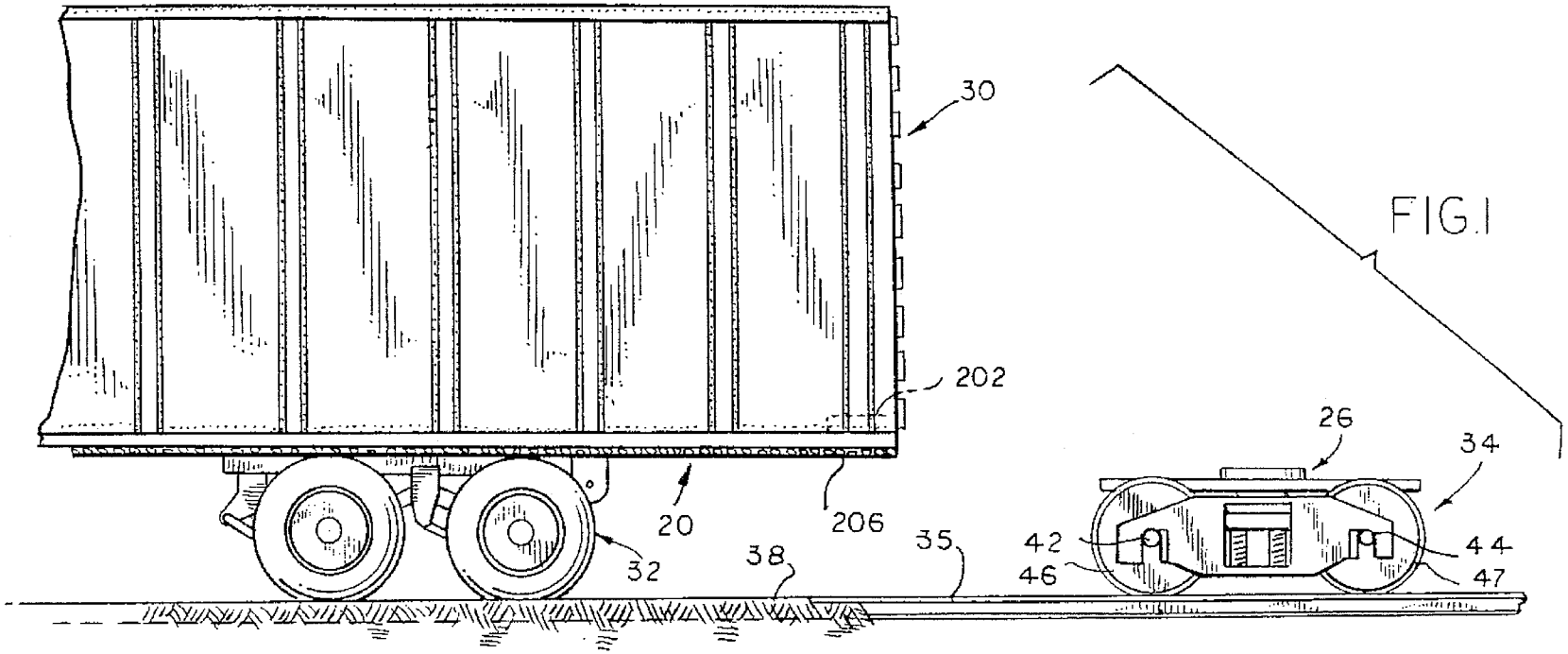
FIG. 1 is a fragmentary side elevational view in simplified form showing an intermodal highway trailer and a rail truck or bogie incorporating features of the present invention prior to assembly of the bogie with the trailer.
Figure 2:
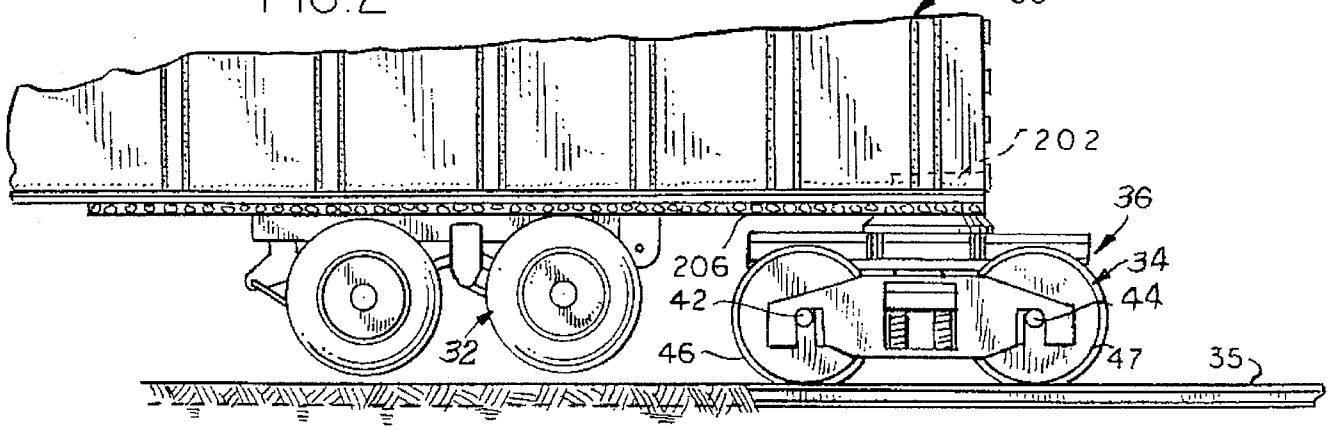
FIG. 2 is a fragmentary side elevational view similar to FIG. 1, but showing the rail truck and adapter connected with the trailer and actuated so as to lift the trailer wheels above the ground.

Referring now more specifically to the drawings, wherein like parts are designated by the same numerals throughout the various figures, an intermodal trailer 30 is shown in FIGS. 1 and 2. The trailer 30 incorporates a conventional wheel assembly 32 for use when the trailer is to be transported over the streets and highways. In accordance with a feature of the present invention, the wheel assembly 32 may be of any well-known or conventional construction, and does not incorporate any means for lifting or extending the wheels for adapting the trailer for either rail or highway use. In other words, the trailer 30 may be of any conventional or known highway construction, except that it is provided with fittings for attachment to a rail bogie, and for attachment of successive trailers to each other when used in the rail mode.

As shown in FIGS. 1 and 2, the present invention contemplates a novel railway truck or bogie 34 adapted to ride on conventional railroad rails 35, and including an adapter 36 constructed in accordance with the present invention. The adapter 36 is constructed in the manner described below, so as to be able to assume a collapsed condition, as shown in FIG. 1, for enabling the bogie to be inserted beneath the highway trailer rear end, as shown in FIG. 2.

In order to facilitate assembly of the highway trailer with the bogie 34, the rails 35 are preferably embedded in the ground or a pavement 38, so that the upper surface of the rails and the upper surface of the pavement 38 are substantially coplanar. The trailer may then be driven and manipulated by a tractor (not shown), so that it is in alignment with the rails 35, and its wheels 32 engage the upper surface of the pavement and/or the rail 35, as shown in FIG. 1. In accordance with a feature of the present invention, the adapter 36 on the bogie 34 is constructed as will be described in detail below, so that it may be manipulated from the collapsed condition shown in FIG. 1 to the raised or extended condition shown in FIG. 2 for lifting the rear end of the trailer and, thus, lifting the trailer wheels 32 above the rails 35 and the pavement.

Thus, the need for mechanisms directly on the trailer for lifting the wheels above the ground, as in prior proposals, is eliminated.

The railway truck or bogie 34 is shown in greater detail in FIGS. 3, 4, 5, and 6. More specifically, the bogie 34 comprises a frame 40, which may be of various conventional constructions, supported on axles 42 and 44 extending through rail wheels 46 and 47. The bogie further comprises a transverse bolster 48 supported on the frame 40 by any of various conventional spring arrangements 49. The bolster 48 presents an upwardly facing central bowl 50 on which the adapter 36 is mounted.

The adapter 36 comprises a bottom adapter assembly or structure 52, which includes a downwardly projecting thrust bearing 54. A pin 56 projects through the thrust bearing 54 and into a socket 57 in the bolster 48, whereby the adapter is connected for pivotal movement relative to the railway truck bolster.

Figure 3:
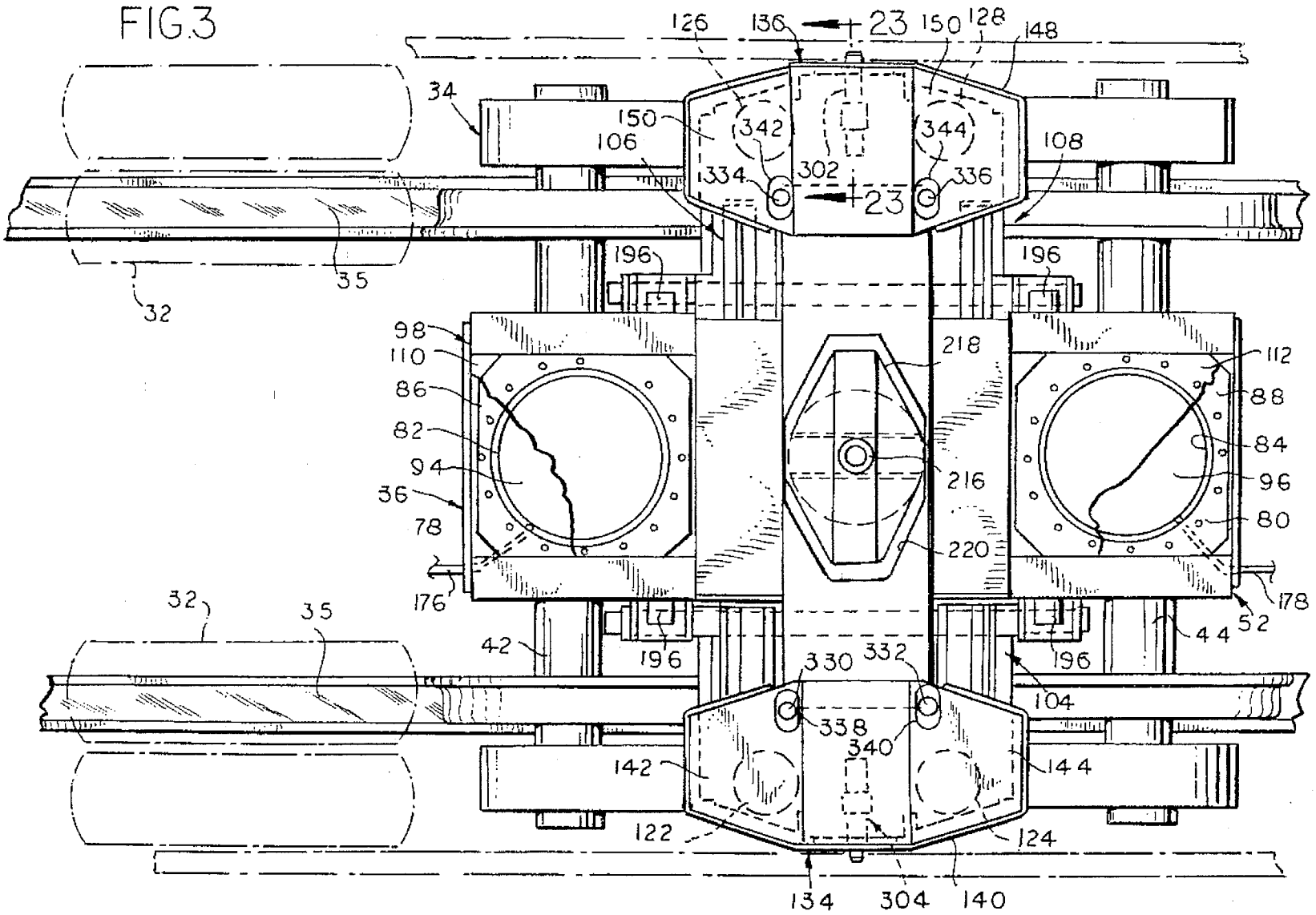
FIG. 3 is an enlarged plan view showing a novel rail truck and adapter assembly incorporating features of the present invention.
Figure 4:
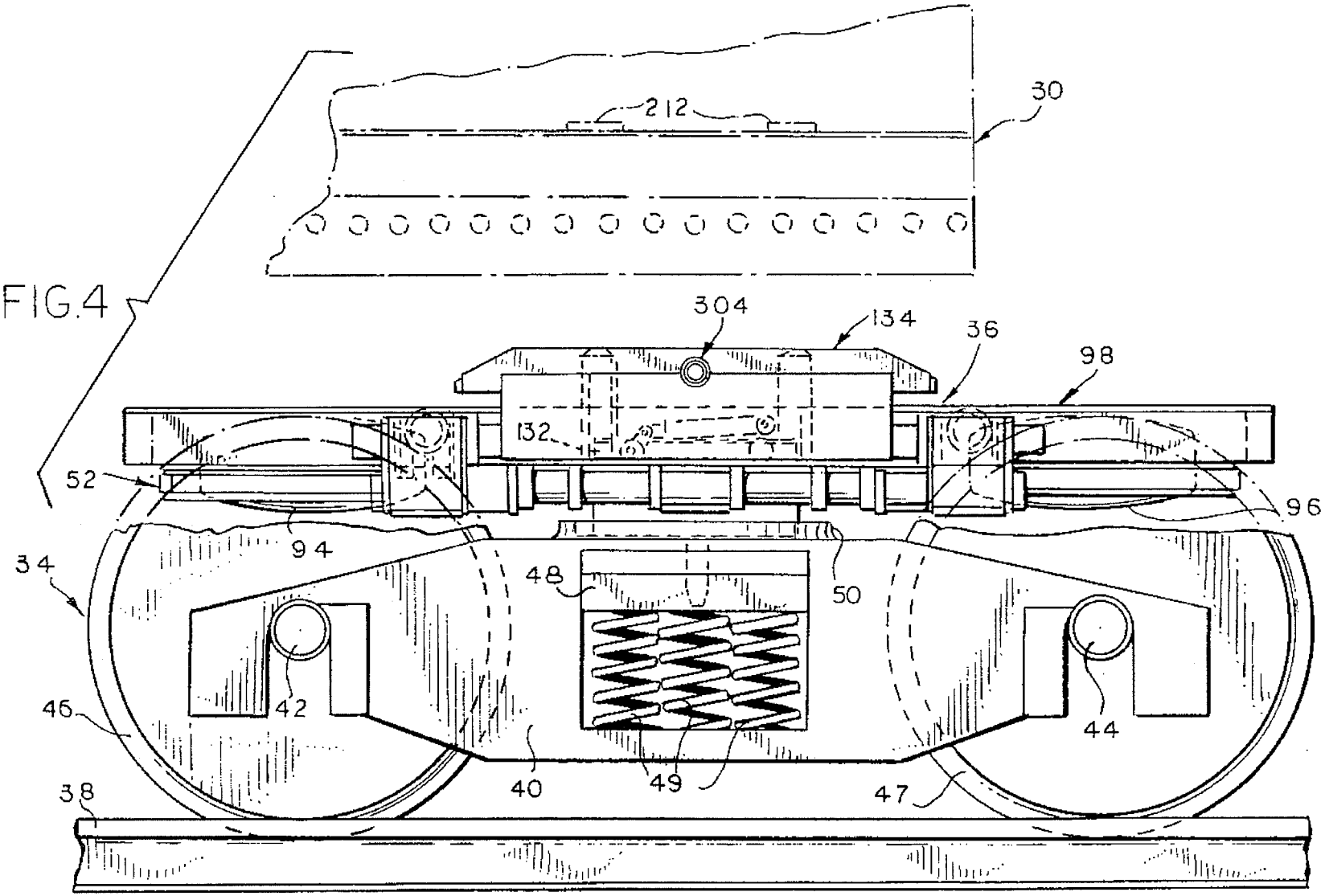
FIG. 4 is a side elevational view of the rail truck and adapter assembly shown in FIG. 3, with the adapter assembly in a collapsed condition.
Figure 5:
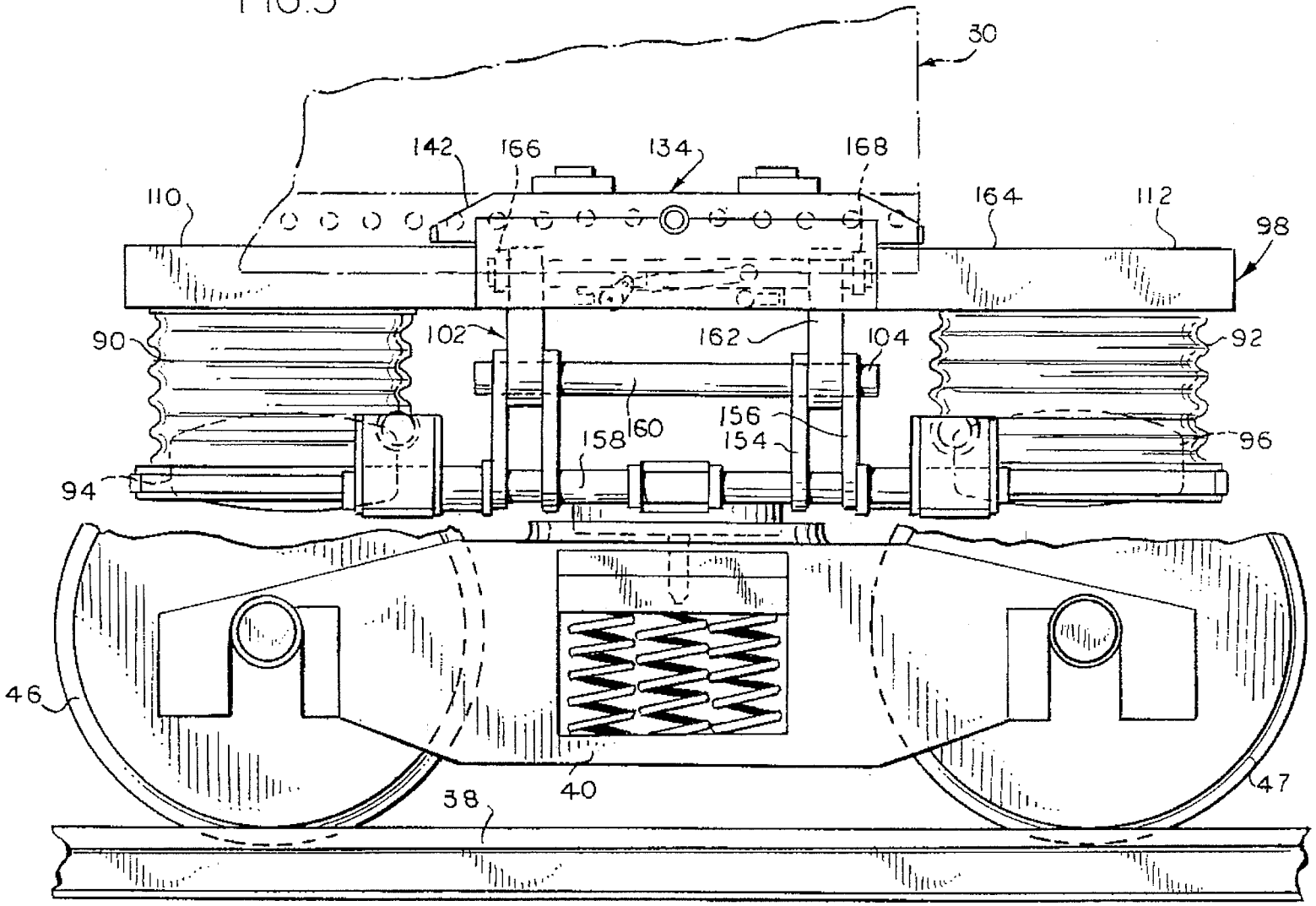
FIG. 5 is a side elevational view similar to FIG. 4, but showing the adapter assembly in a raised or extended condition.
Figure 6:
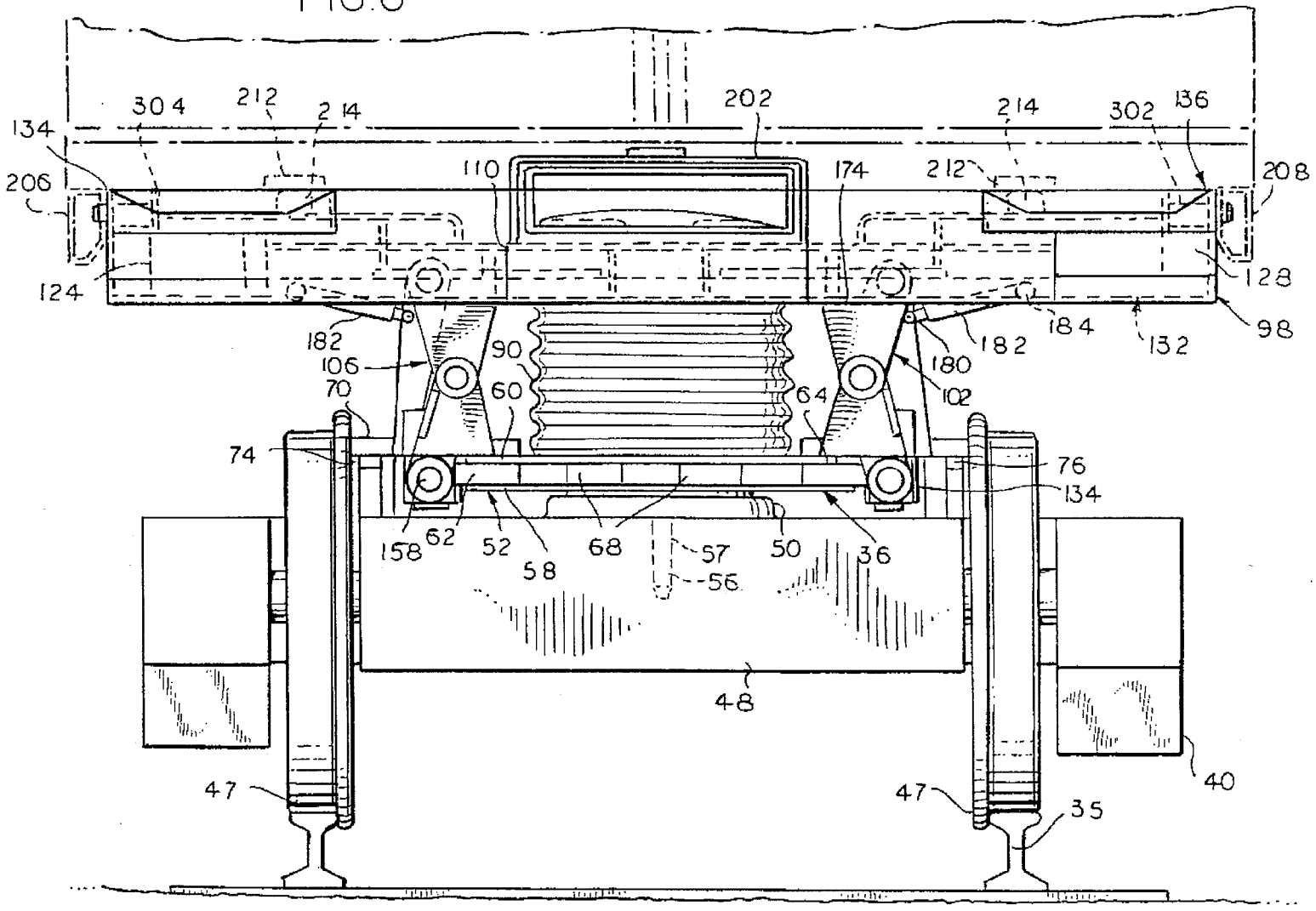
FIG. 6 is an end elevational view of the structure shown in FIG. 5, with the adapter in the raised or extended position.

Referring more specifically to FIGS. 3, 5, and 6, the bottom adapter assembly is a weldment made up of a bottom plate 58, a top plate 60, opposite longitudinally extending side ribs 62 and 64, and intermediate ribs 66 and 68. These parts are welded together so as to provide a relatively lightweight, yet strong and rigid, support for the remainder of the adapter. The thrust bearing 54 is welded, or otherwise secured, to the lower surface of the bottom plate 58. Opposite side wings, or stabilizing bars, 70 and 72 are welded to, and extend laterally from, the top plate 60. These stabilizing wings or bars are adapted to engage bearing pads 74 and 76 on the bolster 48 for minimizing lateral sway or rocking of the adapter on the bolster.

The bottom adapter assembly includes opposite end sections 78 and 80, having apertures 82 and 84 therethrough, which are surrounded by seats 86 and 88. The seats 86 and 88 are adapted to be secured to and to close lower ends of air bags 90 and 92, which provide the lifting means of the adapter 36, as will be described hereinafter. The apertures 82 and 84, through the opposite end plates of the bottom adapter assembly, provide a recess or pocket receiving compressed air tanks 94 and 96 (see FIGS. 3, 4, and 5). These tanks are adapted to be connected to the air line of a rail train braking system for actuating the brakes (not shown) on the rail truck which may be of any known or conventional construction. Furthermore, the tanks or reservoirs 94 and 96 are joined with the seats 86 and 88, so as to seal the lower ends of the air bags 90 and 92. As will be seen from the drawings, the arrangement is such that the tanks 94 and 96 occupy a substantial portion of the interior volume of the air bags. As a result, the volume within the air bags, which are to be filled with air under pressure, is reduced for promoting faster operation of the bags. In addition, the savings in space achieved by locating the tanks at least partially within the air bags, enables the overall height of the railway truck or bogie 36 to be minimized for facilitating insertion beneath the trailer when the adapter is in the collapsed position.

Referring to FIGS. 3–7, it is seen that the adapter 36 includes an intermediate adapter assembly or structure 98 having a central frame 100 extending transversely of the bogie above the bottom adapter 52. The intermediate adapter is connected to the bottom adapter 52 for movement between the lower or collapsed condition shown in FIGS. 1 and 4 and the raised or extended condition shown in FIGS. 2, 5 and 6. The connection between the bottom and intermediate adapters is made by linkage assemblies 102, 104, 106, and 108, which will be described in more detail below.

The intermediate adapter is provided with wings or panels 110 and 112 extending oppositely from the central frame structure 100 over the air bags 90 and 92 respectively. The panels 110 and 112 are secured to and sealed with respect to upper ends of the air bags 90 and 92 and, thus, along with the air bags, provide a part of the lifting means for raising and lowering the intermediate adapter assembly between the raised condition and the lower or retracted condition.

Pairs of shelves 114, 116, 118, and 120 are secured to and project laterally inwardly at opposite ends from opposite sides 119 and 121, of the intermediate frame structure 100, and respectively provide supports for resilient blocks, or marshmallow springs, 122, 124, 126, and 128 formed from rubber or other suitable material. These resilient blocks or marshmallow springs, in turn, support an upper adapter assembly or structure 130 in the manner described below.

The upper adapter assembly 130 includes a plank structure 132 shown in FIGS. 6, 7, 12, and 13 disposed beneath and within the transverse member 100 of the intermediate adapter 98. Bolted or otherwise secured on opposite ends of the plank structure 132 are trailer engaging and supporting bolsters 134 and 136, respectively. The bolsters 134 and 136 have portions projecting laterally from opposite sides of the plank structure 132 for overlying and engaging upper ends of the resilient blocks or pillow springs 124–128. Thus, the upper adapter assembly 98 comprising the plank structure 132 and the bolsters 134 and 136 is resiliently and yieldably supported through the marshmallow springs by the intermediate adapter assembly. The yieldable or floating support for the upper adapter assembly facilitates connection with a trailer since the yielding action can accommodate a certain amount of misalignment between the highway trailer and the bogie. In addition, the bolster 134 has tapered or pointed opposite end sections 138 and 140 which end sections also have beveled or inclined ramp upper services 142 and 144 which serve to guide the bolster into engagement with the highway trailer. The bolster 136 is also provided with corresponding tapered opposite end sections 146 and 148 and upper beveled or cam surfaces 150 and 152.

The linkages 102 through 108 connecting the lower and intermediate adapter assemblies 52 and 98 are shown best in FIGS. 3, 5, 6, and 15–22. Since all of the linkages are essentially identical, only linkage 104 will be described in detail and the same reference numerals will apply to corresponding elements of the other linkages. More specifically, linkage 104 comprises a pair of spaced-apart links 154 and 156 pivotally mounted on a shaft 158 which, in turn, is rotatably supported in bearings 160 and 162 secured to the intermediate adapter 52. Free ends of links 154, 156 are connected by a pin 160 to an end of a link 162 which has its opposite end pivotally supported by shaft 164 mounted by suitable bearings 166 and 168 on the side of the intermediate adapter frame 100.

Figure 21:
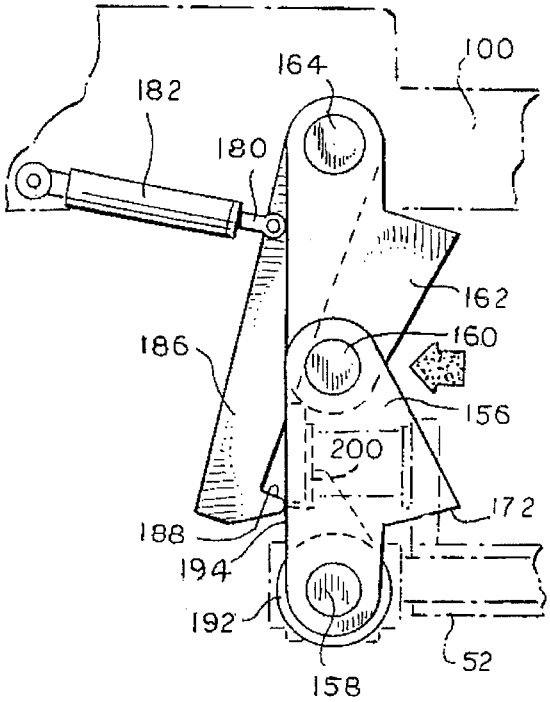
FIG. 21 is similar to FIG. 20, but shows the linkage mechanism in a fully raised dead center condition.
Figure 22:
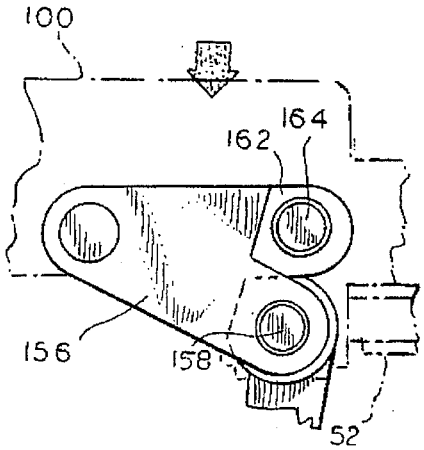
FIG. 22 is a sectional view showing the linkage mechanism at a fully collapsed condition.

As shown in FIGS. 3 and 22, the arrangement of the links is such that when the adapter is in the collapsed condition, the links project generally horizontally laterally outwardly from their respective pivot shafts. Then when the intermediate adapter is raised, the links will move to a top dead center position as shown in FIG. 21. In order to lock the intermediate adapter assembly in the raised condition and prevent unintentional collapse of the adapter, the linkage is constructed for providing a positive stop upon movement past the top dead center position to the position shown in FIG. 19. More specifically, the links 154 and 156 are formed with abutments or shoulders 170 and 172, and the link 162 is formed with a similar, but oppositely facing, abutment 174. The abutments 170 and 172 on the bottom links are positioned for engaging a top plate or other suitable stop element on the lower or bottom adapter assembly 52 when the linkage is moved to the over center position while the abutment or stop shoulder 174 on the link 162 is positioned for engaging a bottom surface or stop element on the intermediate adapter frame 100.

Figure 9:
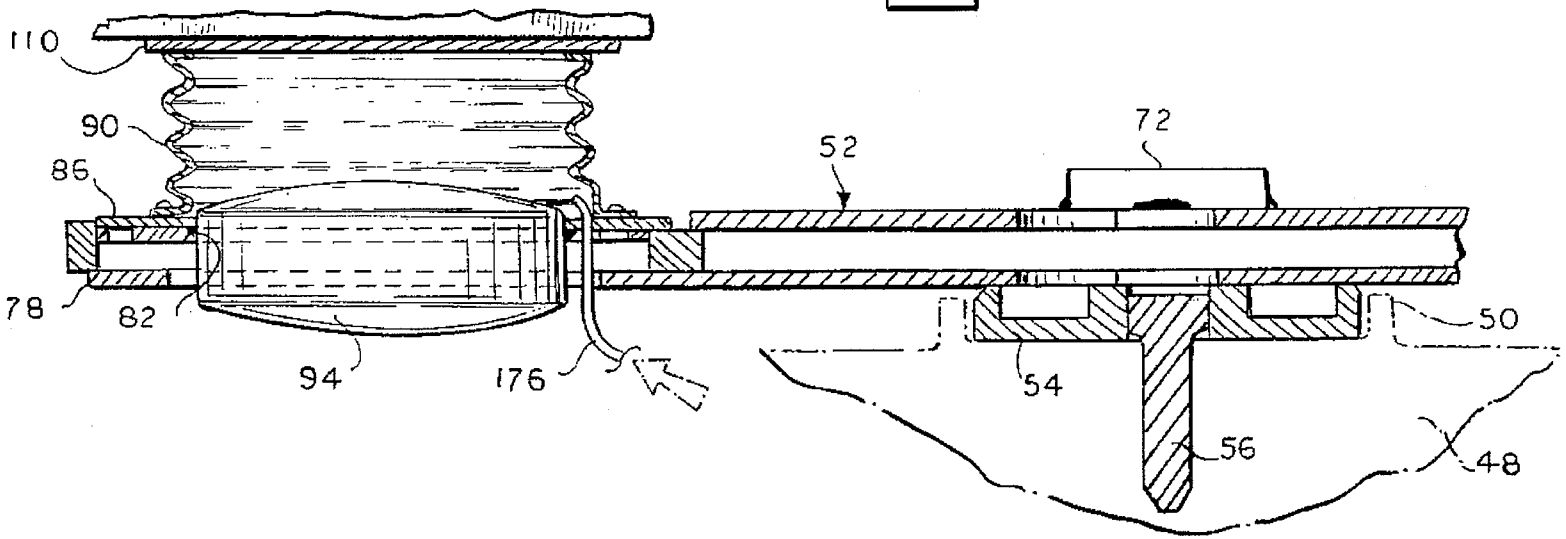
FIG. 9 is an enlarged fragmentary sectional view taken along line 9—9 in FIG. 8.
Figure 10:
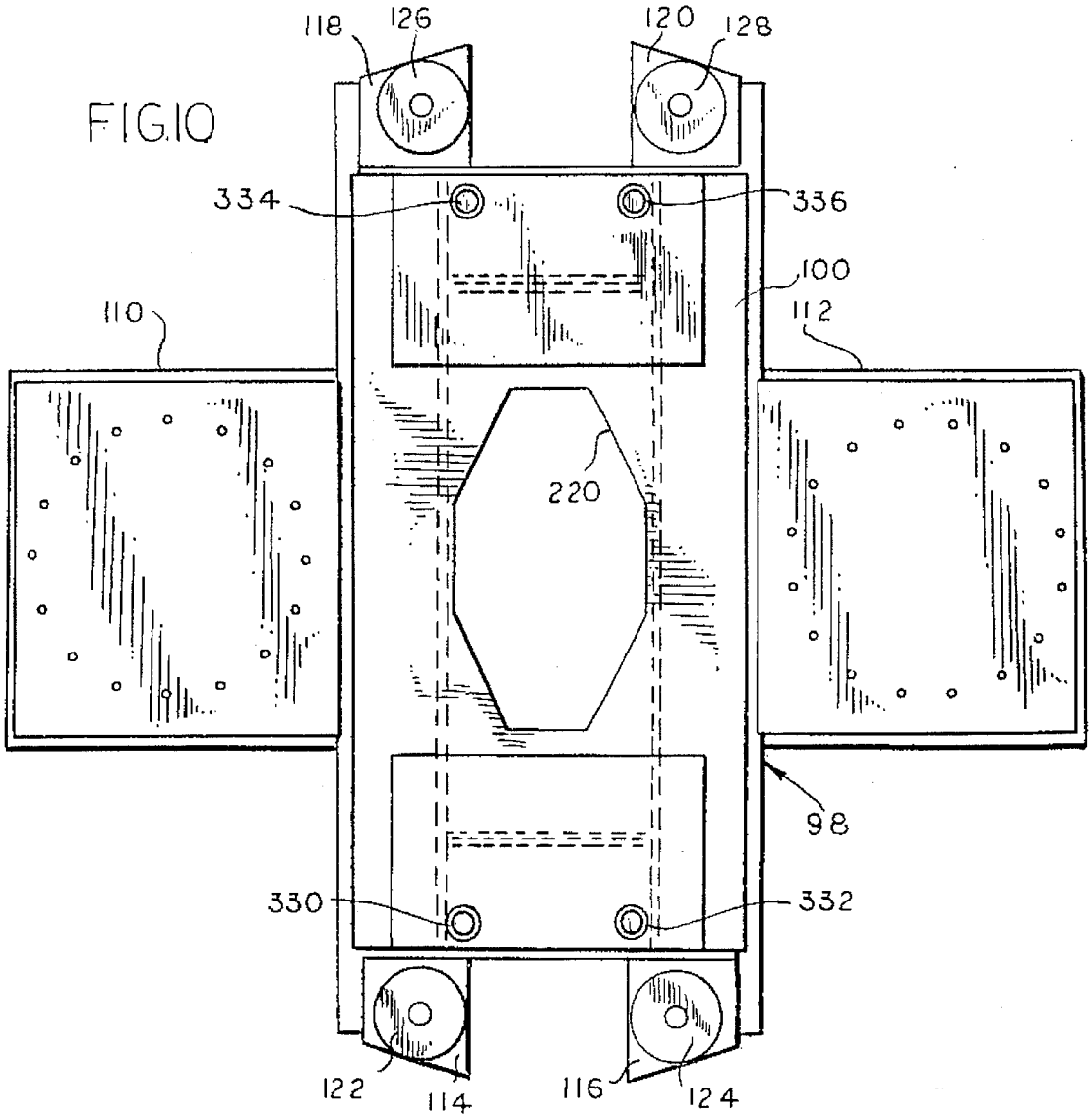
FIG. 10 is a plan view of the intermediate adapter section or assembly incorporated in the present invention.
Figure 11:
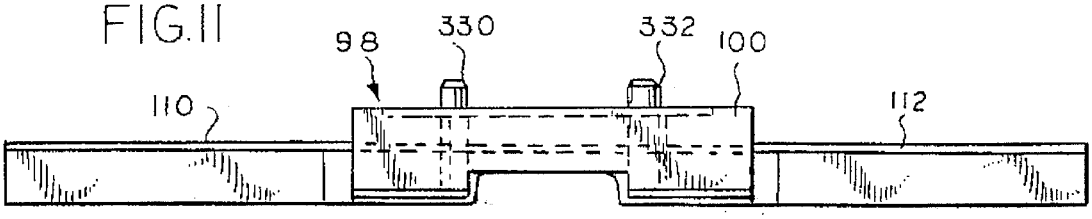
FIG. 11 is a side elevational view of the intermediate adapter assembly.
Figure 12:
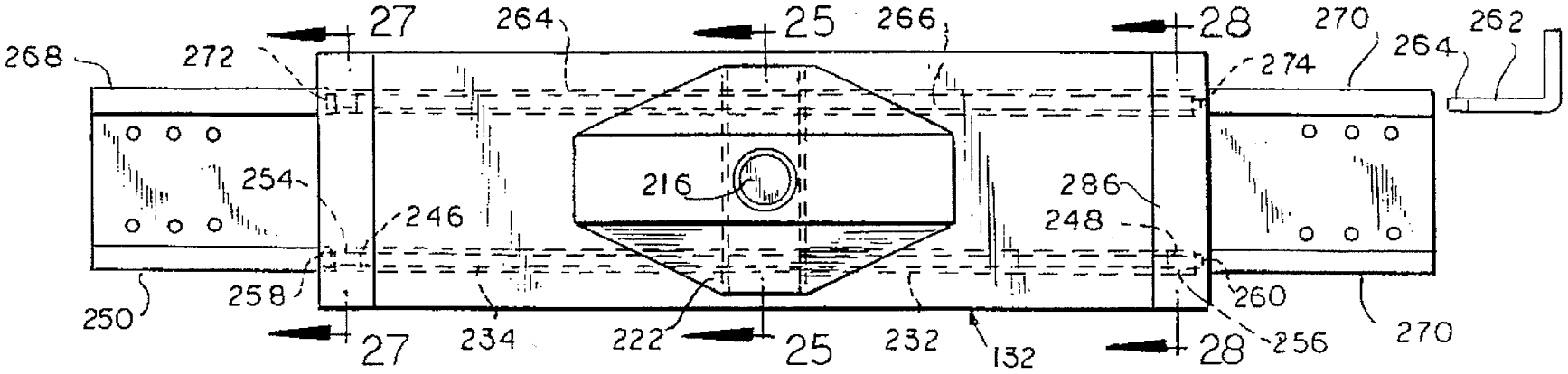
FIG. 12 is a plan view of the upper adapter assembly incorporated in the present invention.
Figure 13:
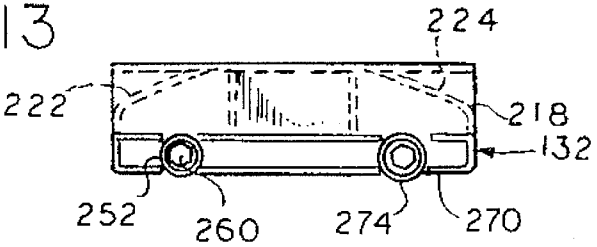
FIG. 13 is an end view of the structure shown in FIG. 12.
Figure 14:
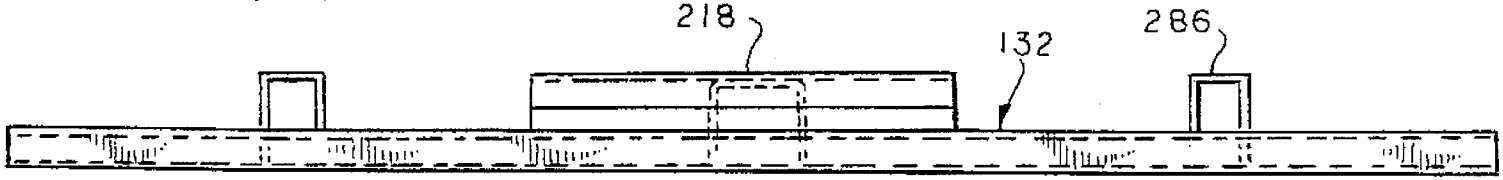
FIG. 14 is a side elevational view of the structure shown in FIG. 12.

When the adapter is to be extended, the air bags are connected by suitable hoses 176, 178 (see FIGS. 3 and 9) to a suitable source of air under pressure (not shown) which is usually separate from the air line of the train braking system. Upon expansion of the air bags, the intermediate and upper adapter assemblies are raised and the linkage moved to the top dead center position as discussed above. In order to ensure that the linkage will then move to the over center position for locking the adapter in the raised condition, a piston or plunger 180 is positioned for biasing the linkage. The plunger 180 extends from a cylinder 182 having an end pivotally connected at 184 to the intermediate adapter frame (see FIGS. 6, 15, and 19–21).

The linkage assembly further includes a latch mechanism for positively securing the linkage in the over center condition whereby to preclude any possible inadvertent lowering of the adapter. Thus, a latch hook 186 is mounted on the shaft 164 and includes an abutment or hook portion 188 engagable with a lock tab 190 welded or otherwise secured to the link 154 and projecting laterally therefrom. As shown best in FIG. 19, when the linkage is in the over center position, the hook shoulder 188 engages beneath the tab 190 so as positively to preclude reverse movement of the linkage. The plunger 180 is connected to element 186 for urging the linkage past the dead center position, as shown in FIG. 21, when the hook portion 188 bears against the outer surface of the tab 190, and for snapping the hook portion 188 beneath the tab 190 when the parts reach the position shown in FIG. 19.

Figure 15:
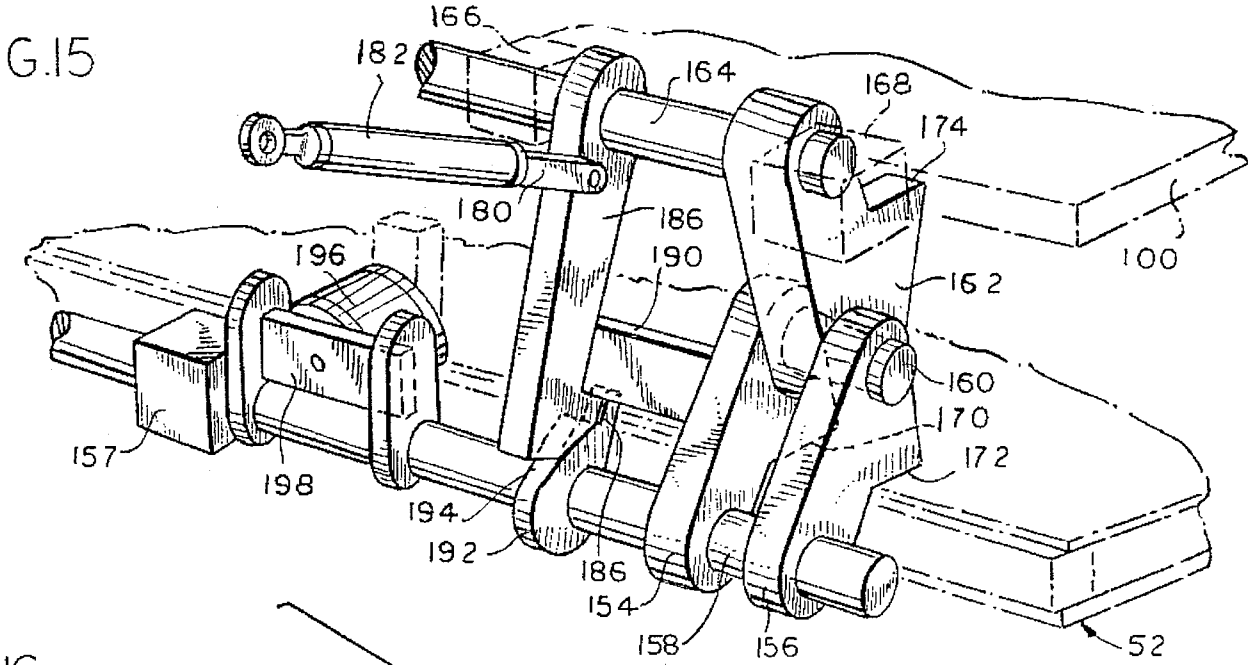
FIG. 15 is an enlarged fragmentary perspective view showing a linkage mechanism connecting the lower and intermediate adapter assemblies of the present invention.
Figure 18:
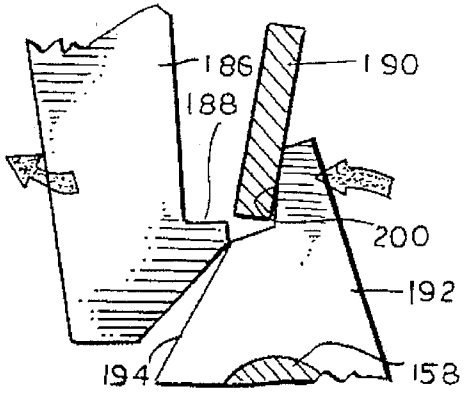
FIGS. 16, 17 and 18 are further enlarged fragmentary views showing portions of the linkage mechanism in successive positions during operation.
Figure 17:
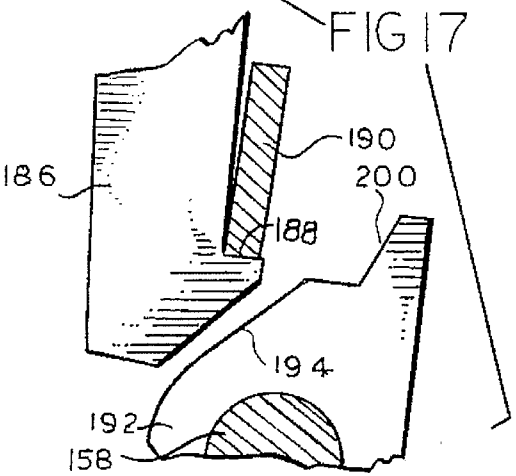
Figure 16:
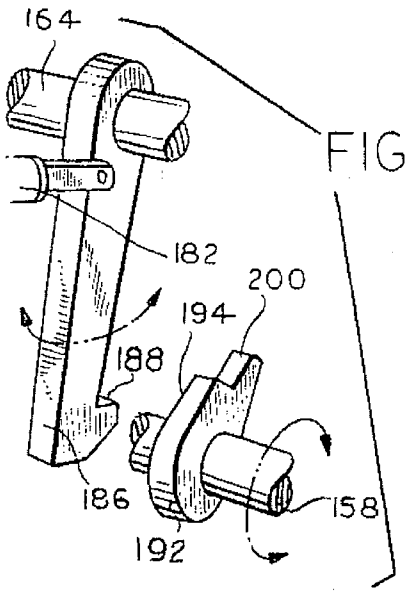

In order to release the latch element 186 when it is desired to lower the adapter to its collapsed condition, a cam 192 is fixed on shaft 158 and presents a cam surface 154 engagable with an end of the latch element 186. The shaft 190 is actuated or rotated by means of an air bag 196 or other suitable actuating means disposed between a tab 198 fixed on the shaft 158 and a side of the lower adapter frame, as shown in FIGS. 3 and 15. The cam element 192 serves not only to release the latch member 186, but it also functions to force the linkage outwardly past top dead center when it is desired to lower the adapter. More specifically, the cam element 192 is provided with a second cam surface 200 which is positioned for engaging the lock tab 190 after the latch element has been disengaged.

Figure 19:
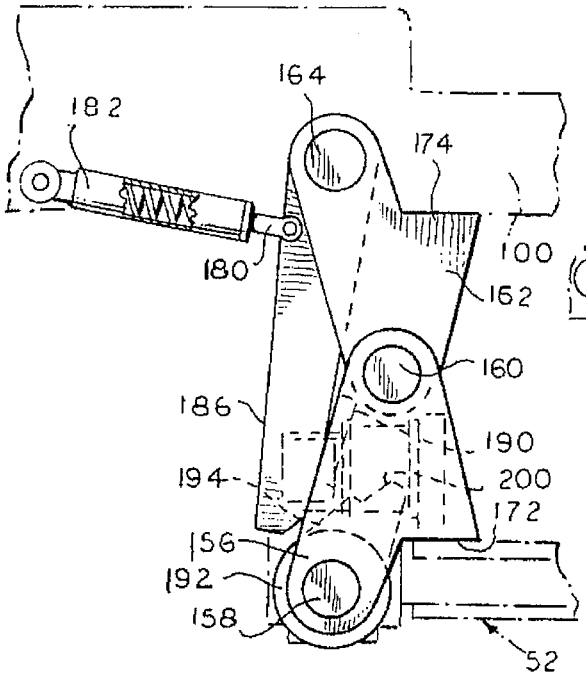
FIG. 19 is a fragmentary partial sectional view taken along line 19—19 in FIG. 15 showing the linkage mechanism is a raised and locked condition.
Figure 20:
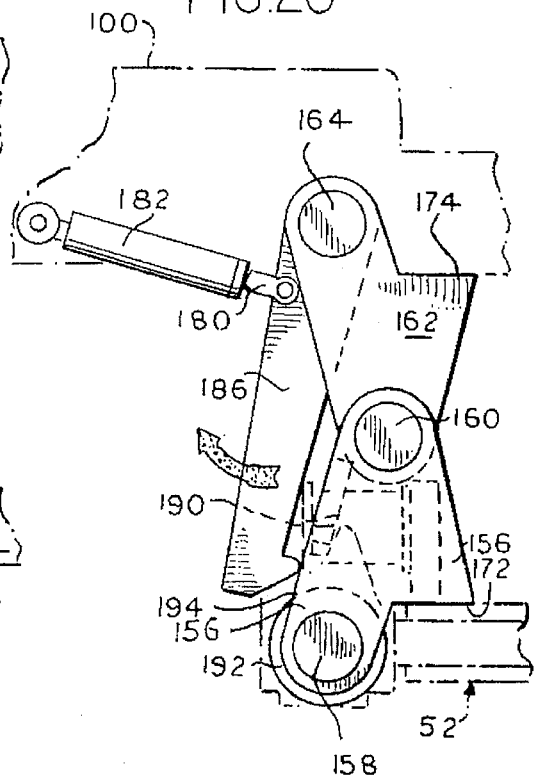
FIG. 20 is a fragmentary sectional view similar to FIG. 19 showing the linkage mechanism manipulated so as to be unlocked.

When it is desired to lower the adapter to the collapsed condition, when the linkage is in the over-center and locked condition shown in FIGS. 6, 15, and 19, the air bags 196 are first actuated or expanded to cause the cams 192 to release the latch elements 186. The air bags 90 and 92 are also inflated for raising the intermediate and upper adapter assemblies until the linkage is in the top dead center position shown in FIG. 21. At this point, the cams 192 under the influence of the air bags 196, urge the links outwardly past the top dead center position so that, upon deflation of the air bags 90, 92, the intermediate and upper adapter assemblies will be lowered to the collapsed condition.

In order to connect successive trailers in a train to each other and to a bogie 36, the trailer is provided with fittings of a type generally known in the art. For example, the trailer is provided with a socket 202 at the rear end thereof, as shown in FIGS. 1, 2, 6, 25, and 26. The socket 202 is adapted to receive a tongue 204 secured to and projecting forwardly from the front end of a trailer. Reference is again made to U.S. Pat. No. 5,040,466 for a more complete disclosure of a suitable socket and tongue structure. In addition, the trailer is provided with opposite side rails 206, 208 (see FIGS. 1, 2, 6, 23, and 24) having apertures 210 therein for receiving laterally projecting pins to be described below. Pairs of downwardly opening pockets or sockets 212, 214 (see FIGS. 4 and 6) on the bottom of the trailer are disposed for receiving additional pins projecting upwardly from the adapter 36 of the bogie 34, which pins will also be described below.

Figure 7:
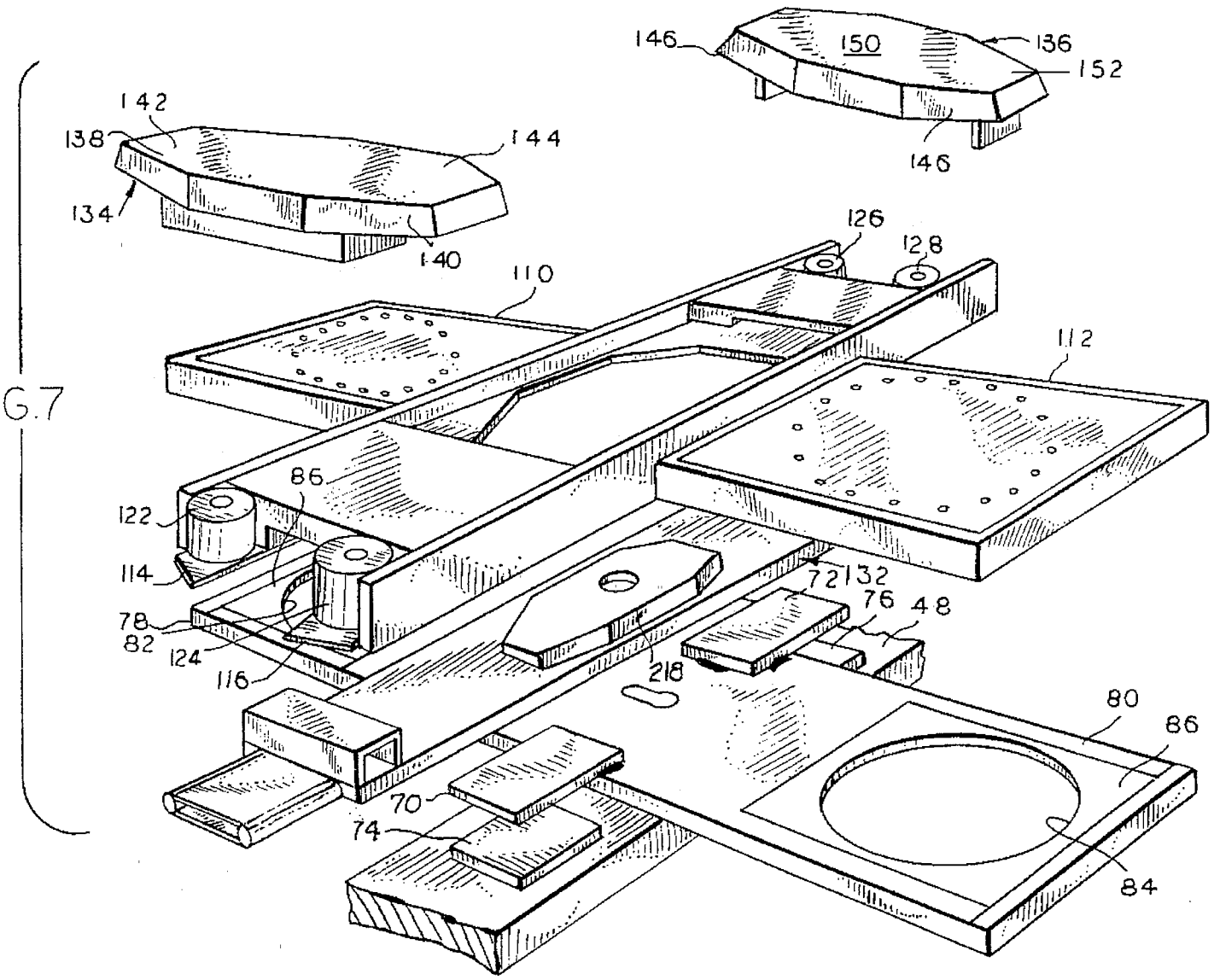
FIG. 7 is an exploded simplified perspective view showing bottom, intermediate and upper adapter assemblies incorporated in the structure of the present invention.
Figure 8:
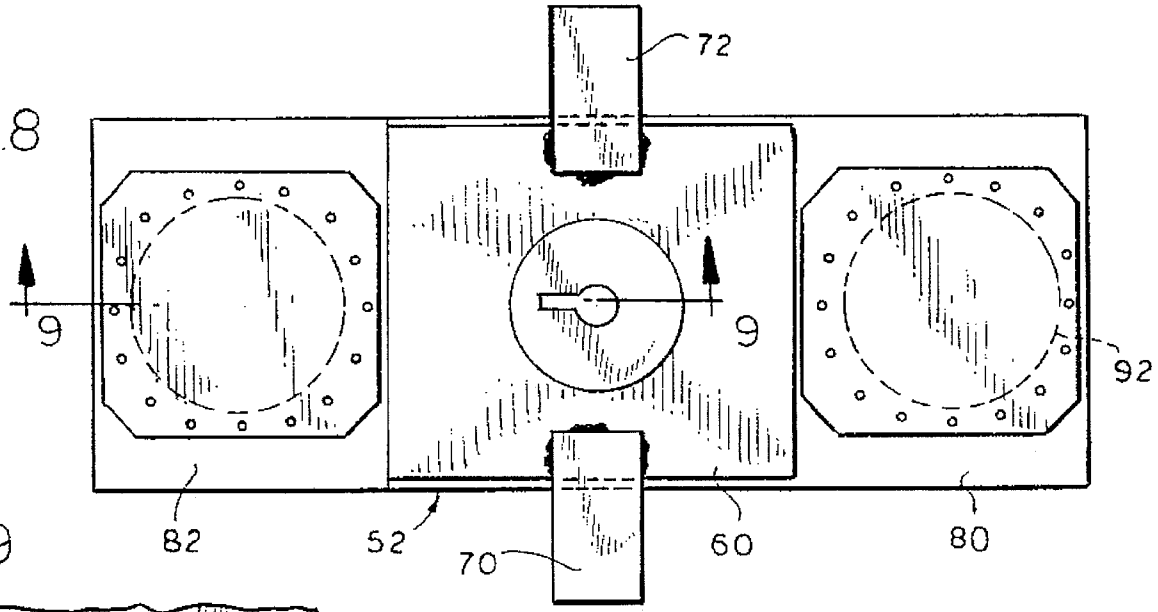
FIG. 8 is a plan view on a reduced scale of the lower adapter section or assembly including lifting devices in the form of air bags incorporated in the present invention.
Figure 26:
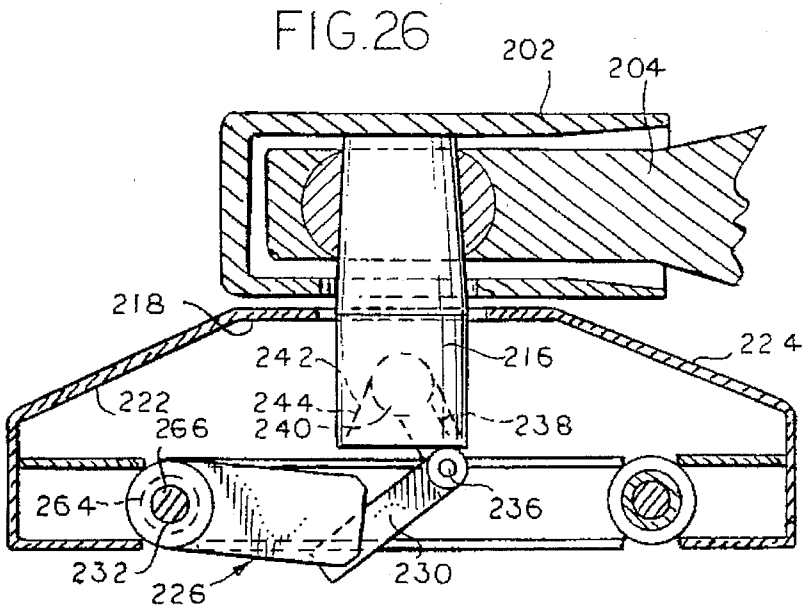
FIG. 26 is similar to FIG. 25, but shows the coupler mechanism in an extended condition.
Figure 25:
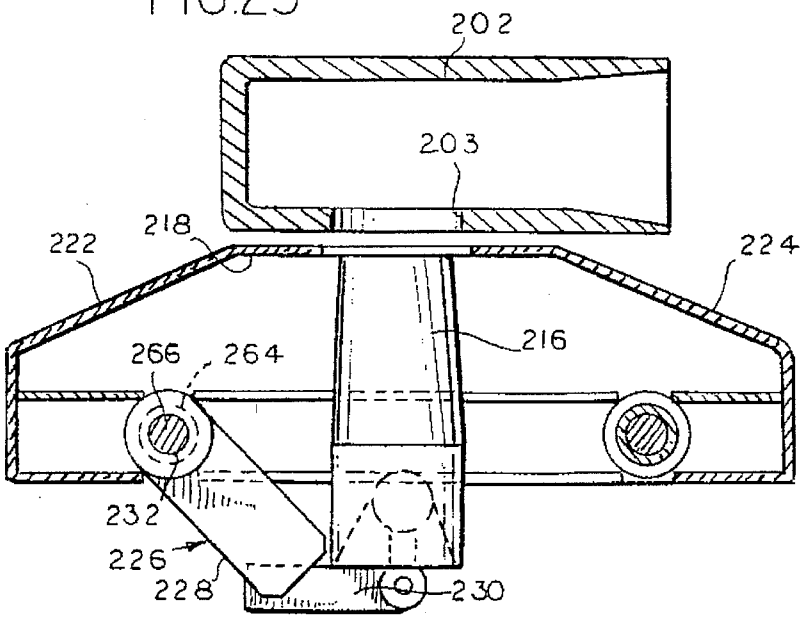
FIG. 25 is an enlarged fragmentary sectional view taken along line 25—25 of FIG. 12 showing a coupling pin mechanism carried by the upper adapter assembly in a retracted condition.
Figure 27:
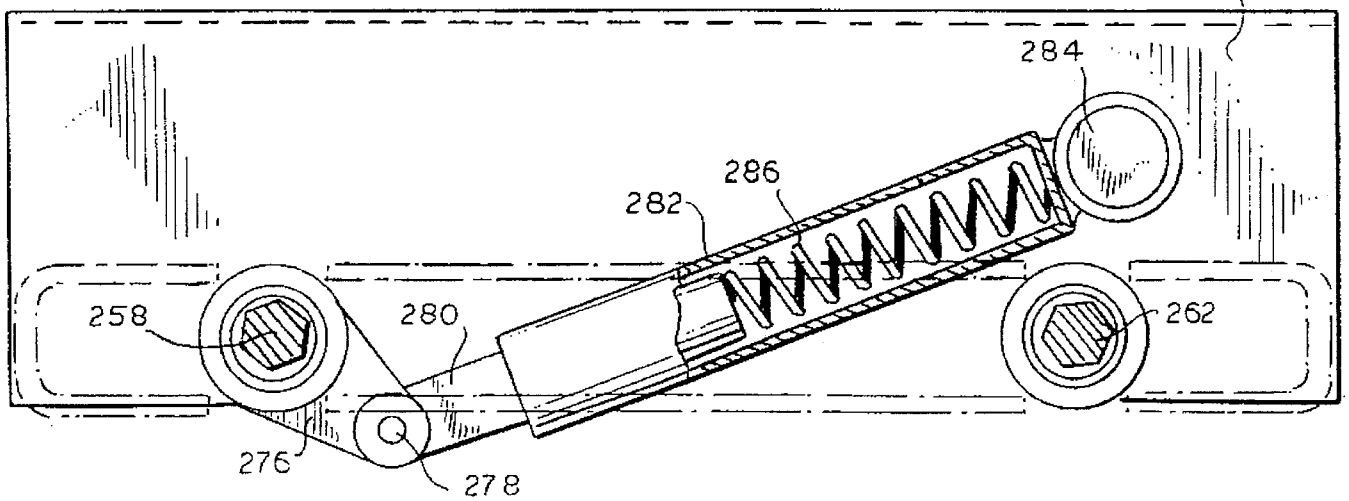
FIG. 27 is an enlarged partial sectional view taken generally along line 27—27 in FIG. 12 and showing an overcenter mechanism for urging the coupling pin to the extended position shown in FIG. 26.

In order to connect the bogie adapter with a trailer, and also to secure the tongue 204 of a trailing trailer in the socket 202, the adapter is provided with a coupling pin 216 shown in FIGS. 3, 12, 25, and 26. The coupling pin 216 is retractable within a housing 218 mounted on the plank portion 132 of the upper adapter 130, thus forming a part of the upper adapter 130. The housing 218 is positioned for projecting upwardly through a complementary opening 220 formed in the upper deck of the intermediate adapter member 100 as shown in FIGS. 3 and 7. As shown in FIGS. 25 and 26, the housing 218 has cam sections or inclined ramps 222, 224 for facilitating sliding of the adapter beneath an end of a trailer with which it is to be connected. The arrangement is such that the adapter can be selectively connected in opposite directions with a complementary trailer.

The coupling pin 216 is supported for movement between a retracted position and an extended position by a bell crank 226 having rigidly interconnected arms 228 and 230. The arm 228 is fixed to a shaft 232, rotatably supported within a fixed guide tube 234 of the upper adapter plank structure 132. An opposite free end of the bell crank is pivotally connected by pin 236 with a link 238 having a ball 240 at its free end which fits in a seat 242 in the lower end of the coupling pin. The seat has a frusto-conical portion 244 which provides clearance for the link 238 when the mechanism is actuated from the retracted position shown in FIG. 25 to the extended position shown in FIG. 26.

Referring particularly to FIGS. 12–14, 27–28, it is seen that the guide tube 234 terminates adjacent opposite ends of the upper adapter assembly plank structure 132 at 246 and 248, and is axially aligned with opposite end guide tubes 250 and 252, respectively, which are spaced so as to provide gaps 254 and 256 for the purpose described below. Opposite end portions 258 and 260 of the shaft 232 are provided with a hexagonal or other suitable shape adapted to be engaged and driven by a suitable crank or wrench 262 having a complementary socket end portion 264 (see FIG. 12). The shank of the wrench or crank 262 is adapted to be inserted into either of the guide tubes 250 and 252 for engagement with the hex end of the shaft 232, whereby the shaft can be rotated and, thus, the coupling pin 216 can be actuated from opposite sides of the bogie. Another elongated guide tube 264 extends through the upper adapter assembly plank structure 132 for rotatably supporting another shaft 266 parallel to the shaft 232. The guide tube 264 also is aligned with spaced opposite end guide tubes 268 and 270 into which the crank or wrench 262 may be selectively inserted for engagement with hexagonal end portions 272 and 274 of the shaft 266.

As indicated above, the shaft 232 may be rotated or driven by the crank 262 for shifting the coupling pin between the positions shown in FIGS. 25 and 26. A yieldably biased over-center mechanism is provided for promoting efficient rotation of the shaft 232 to ensure full retraction and extension of the coupling pin 216 to the tongue decoupling position shown in FIG. 25 and the coupling position of FIG. 26, respectively. This over-center mechanism is shown best in FIG. 27, and comprises a lever arm 276 fixed on the shaft 232 and projecting outwardly of the slot 256. An outer end of the lever 276 is connected by pivot pin 278 with a plunger 280 projecting from a cylinder 282 pivotally connected to an anchor pin 284 secured to a housing 286 fixed on the plank structure 132 of the upper adapter assembly 130. A spring 286 or other suitable means is provided in the cylinder 282 for biasing the piston 280. The arrangement is such that when the shaft 232 is rotated in a clockwise direction from the coupling position of FIG. 26, the lever 276 will move from the coupling position past dead center to the decoupling position shown in broken lines in FIG. 27, in which position the coupling pin will be fully retracted. Then, when it is desired to raise the coupling pin, the shaft 232 is driven in the counterclockwise direction. When the lever 276 reaches the dead center position, the piston 280, which is biased by the spring 286 or other suitable means within the cylinder 282, acts to push the lever 276 to its coupling position. In fact, the arrangement is such that the plunger 280 will alternately bias toward both the coupling position and the lever 276 decoupling position.

Figure 28:
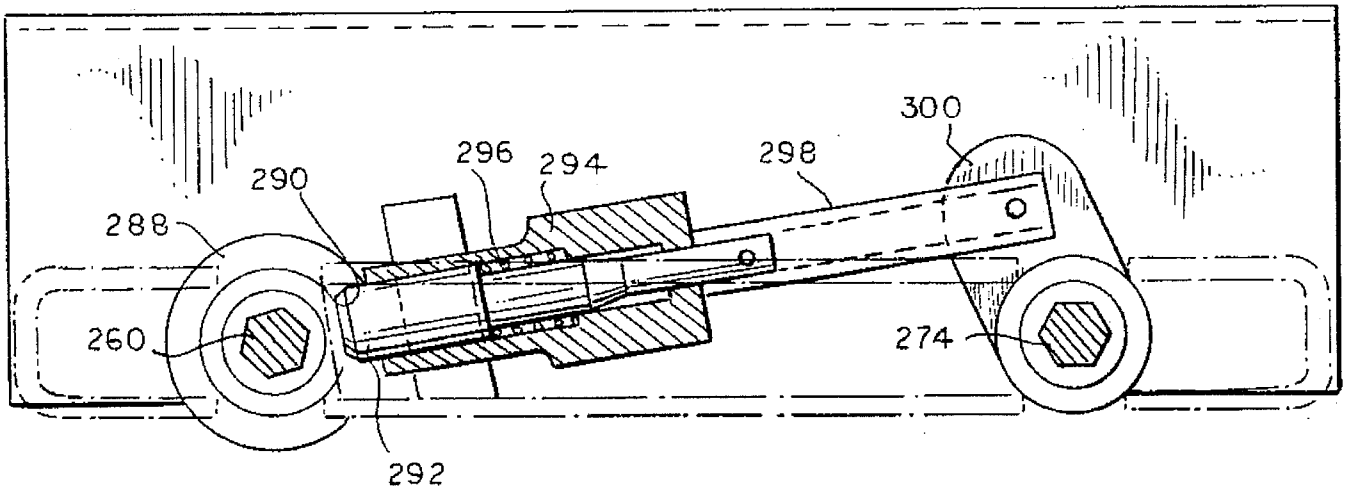
FIG. 28 is an enlarged partial sectional view taken along line 28—28 in FIG. 12 showing a safety locking pin for locking the coupling pin in the extended condition of FIG. 26.

In order positively to lock the coupling pin 216 in its elevated tongue engaging position and, thus, preclude any possibility of accidental decoupling of the trailers, a locking mechanism shown in FIG. 28 is provided. This mechanism comprises a cam 288 fixed on the shaft 232 and projecting through the gap 258. The cam 288 has a shoulder 290 adapted to be engaged by a retractable locking pin 292 for positively precluding clockwise rotation of the shaft 232, as viewed in FIG. 28 and, thus, lowering of the coupling pin. The locking pin or plunger 292 slidably extends through a sleeve 294 fixably mounted on the plank structure 132 of the upper adapter. A spring 296 within the sleeve or housing 294 biases the pin 292 against the periphery of the cam 288, so that when the cam is rotated to the position shown in FIG. 28, at which the coupling pin 216 will be fully extended, the pin 292 automatically snaps beneath the shoulder 290 and prevents retrograde rotation of the cam and thus the shaft 232. In order to unlock the shaft 232 when it is desired to lower the coupling pin 216, the pin 292 is first withdrawn sufficiently so that it is disengaged from the shoulder 290. This is accomplished by connecting the pin 292 through a link 298 with a lever 300 fixed on the shaft 266, as shown in FIG. 28. As previously indicated, the shaft 266 may be selectively actuated from opposite sides of the bogie by the crank or handle 262.

Figure 24:
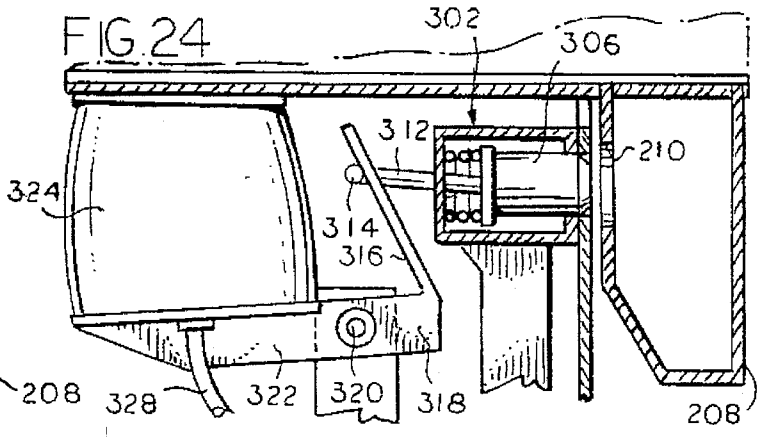
FIG. 24 is similar to FIG. 23, but shows the pin in a retracted condition.
Figure 23:
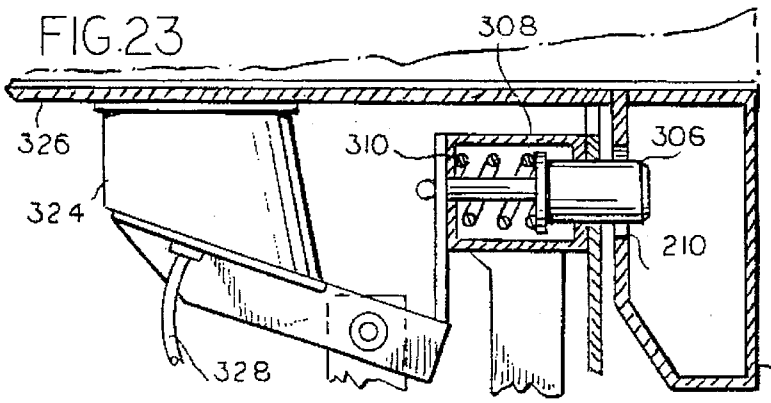
FIG. 23 is an enlarged fragmentary sectional view taken generally along line 23—23 in FIG. 3 and showing a trailer engaging pin carried by the upper adapter assembly in an extended condition.

While the coupling pin 216 provides a first connection between the bogie adapter and a trailer, additional connections are provided for resisting lateral or twisting movement of the back end of the trailer to which the bogie is connected while the coupling pin 216 permits relative pivotal movement between the bogie and the tongue of a trailing trailer. More specifically, lateral coupling pin assemblies 302 and 304 are carried by the upper adapter bolsters 134 and 136, as shown best in FIGS. 3, 6, 23, and 24. Since these pin assemblies are identical, only the one shown in FIGS. 23 and 24 will be described in detail. The pin assembly 302 comprises a pin 306 adapted to be moved from an extended position, shown in FIG. 23, in which it projects through an aperture 210 in the trailer side rail 208 and a retracted position shown in FIG. 24. The pin 306 extends from a fixed housing 308 in which a compression spring 310 is disposed for urging the pin toward its extended position. A shaft 312 extends rearwardly from the housing and has a hook portion 314 engagable with an arm 316 of a bell crank 318 pivotally supported by pin 320. An opposite arm 322 of the bell crank carries an air bag or other suitable actuator 324 secured between the arm 322 and a top panel 326 of the bolster 136. Air under pressure is adapted to be supplied to the air bag 324 from an auxiliary air source, not shown, through a conduit or air line 328. The arrangement is such that when the air bag is deflated as shown in FIG. 23, the spring 318 causes the pin 306 to be extended for engagement with the trailer rail 208. When it is desired to disconnect the bogie from the trailer, air bag 324 is inflated, as shown in FIG. 24, so that the pin 306 is retracted.

A further connection between the bogie adapter and the trailer is obtained by means of upstanding fixed pins 330, 332, 334 and 336 which are positioned and adapted to project into the pockets or socket members 212, 214 on the underside of the trailer. The pins 330 through 336 are respectively fixed on the frame 100 of the intermediate adapter and are aligned for projecting through slots 338, 340, and 342, 344 in the bolsters 134 and 136. The arrangement is such that when a trailer is loaded onto the adapter, the marshmallow springs 122, 124, 126, and 128 will be compressed under the weight of the trailer. As a result, the pins 330 through 336 will be relatively projected through the slots 338 through 344 and into the sockets 212 and 214.

While the operation of the bogie of the present invention is apparent from the foregoing description, a brief summary of the operation will follow. Assuming that the bogie is to be installed under a trailer, as shown in FIGS. 1 and 2, the adapter is first positioned in its collapsed condition, whereupon the bogie may be moved beneath the trailer. Then, the air bags 90, 92 are inflated, so that the intermediate and upper adapter assemblies are raised from their lowered conditions, as shown in FIG. 1, toward the extended position, as shown in FIG. 2. During raising of the intermediate adapter assembly, the connecting linkages 102–108 move from the collapsed condition shown in FIG. 22 to the top dead center position shown in FIG. 21, at which point the spring biased plunger 180 urges the linkage past dead center. Then, upon deflation of the air bags, the intermediate adapter assembly is lowered until the linkage reaches the position shown in FIG. 19, at which it provides a positive stop precluding further lowering. At the same time, the plunger 180 biases the latch or lock member 186, so that it engages beneath the lock tab 190, as shown in FIG. 19.

When the intermediate and upper adapter assemblies are raised to their extended position, the adapter bolsters 134 and 136 engage and lift the trailer sufficiently to raise the trailer wheels above the ground. The weight of the trailer is thus supported by the adapter bolsters 134 and 136, so that the marshmallow springs are compressed sufficiently to cause the pins 330–336 to project above the bolsters 134 and 136 to enter the pockets or sockets 212 and 214 in the bottom of the trailer, or obtaining a preliminary connection between the trailer and the adapter. During such assembly of the adapter with the trailer, the air bags 324 are inflated, so that the pins 306 are retracted. When the assembly is completed, the air bags 324 are deflated for enabling the pins 306 automatically to project into apertures 210 in the side rails of the trailer for obtaining a further connection. In addition, a workman will rotate the shaft 232 with the aid of hand crank 262 for driving the coupling pin 216 upwardly through a vertically aligned aperture 203 in the fitting or socket 202. When a trailing trailer is to be coupled with a leading trailer, the tongue 204 is inserted into the socket 202 prior to raising of the coupling pin 216.

While a preferred embodiment of the present invention has been shown and described herein, many structural modifications can be made without departing from the spirit and scope of the appended claims.

The invention is claimed as follows:

1. A rail bogie comprising a first adapter structure, a second adapter structure detachably connectable to a rail highway vehicle having highway wheels, means connecting said second adapter structure to said first adapter structure for movement between a lowered position and a raised position for raising the highway wheels into the air, and a lift between said first adapter structure and said second adapter structure for raising and lowering said second adapter structure, wherein said lift comprises air bag means including a collapsible wall defining an interior space, and said rail bogie includes a compressed air tank connectable with bogie brakes disposed at least partially within, and said interior space.

2. A rail bogie, as defined in claim 1, wherein said second adapter structure comprises an intermediate adapter and an upper adapter, means yieldably supporting said upper adapter on said intermediate adapter, and means on said upper adapter for releasably coupling the upper adapter with a trailer.

3. A rail bogie, as defined in claim 2, wherein said coupling means comprises a vertical coupling pin centrally positioned on said upper adapter, and shiftable between a raised trailer coupling position and a retracted position.

4. A rail bogie, as defined in claim 3, wherein said coupling means comprises a horizontal pin shiftable laterally between an extended trailer coupling position and a retracted position.

5. A rail bogie comprising a first adapter structure, a second adapter structure detachably connectable to a rail highway vehicle having highway wheels, means connecting said second adapter structure to said first adapter structure for movement between a lowered position and a raised position for raising the highway wheels into the air, a lift between said first adapter structure and said second adapter structure for raising and lower said second adapter structure, said connecting means comprising a linkage for locking said second adapter structure in a raised position, said linkage comprising a first link pivotally connected to said first adapter structure, and a second link having one end pivotally connected to said first link, and an opposite end operatively pivotally interconnected with said second adapter structure, said links being disposed in a folded condition when said second adapter structure is in said lowered position, and being movable through a dead center position to an over-center position when the second adapter structure is in said raised position, and said first and second links including abutments respectively engageable with said first adapter structure and said second adapter structure when the links are in said over-center position for precluding lowering of the second adapter structure.

6. A rail bogie, as defined in claim 5, which includes means for biasing the links from said dead center position toward said over-center position.

7. A rail bogie, as defined in claim 5, which includes latch means for locking said links in said over-center position.

8. A rail bogie, as defined in claim 7, which includes cam means for engaging and releasing said latch means, and for urging said links back across said dead center position when the lift is actuated for lowering said second adapter structure.

9. An adapter for a rail bogie for connection to a rail highway trailer having highway wheels, said adapter comprising a bottom adapter structure, an intermediate adapter structure, air bag means between said bottom adapter structure and said intermediate adapter structure for selectively raising and lower intermediate adapter structure, means on said intermediate adapter structure for coupling the adapter to a trailer, linkage between the bottom and intermediate adapter structures for guiding the intermediate adapter structure for movement between a raised position and a lowered position, and for releasably locking the intermediate adapter structure in said raised position, and said linkage comprising a first shaft rotatably mounted on said bottom adapter structure, a second shaft mounted on said intermediate adapter structure, first and second links respectively pivotally mounted on said first and second shafts, and also pivotally connected to each other, said links, including shoulders, respectively engageable with said bottom and intermediate adapter structures when said intermediate adapter structure is in the raised position for preventing lowering of the intermediate adapter structure.

10. An adapter, as defined in claim 9, wherein said links are movable from a folded condition when the intermediate adapter structure is in the lowered position through a top dead center position to an over-center position when said intermediate adapter structure is in said raised position, and said linkage including a cam on said first shaft for moving said links back through said top dead center position when the air bag means is actuated for lowering the intermediate adapter structure, and an actuator connected with said first shaft for rotating the first shaft to actuate said cam.

11. An adapter, as defined in claim 10, wherein said linkage includes a locking tab on said first link, a latch member mounted on said second shaft and releasably engageable with said tab for locking the second adapter structure in said raised position, and said cam being engageable with said latch member for disengaging the latch member from said tab when the actuator is operated.

12. An adapter, as defined in claim 11, which includes means for biasing said links over the top dead center position toward said raised position when said intermediate adapter structure is being shifted from said lowered position to said raised position.

13. An adapter, as defined in claim 10, wherein said actuator comprises an air bag between said shaft and said bottom adapter structure.

14. An adapter, as defined in claim 9, wherein said means for coupling the adapter to a trailer comprises an upper adapter structure, means yieldably supporting said upper adapter structure on said intermediate adapter structure, and retractable and extendable pin means on said upper adapter structure selectively for engaging a trailer.

15. An adapter, as defined in claim 14, wherein said pin means comprises a coupling pin, a shaft rotatable on said upper adapter structure, linkage between said shaft and said coupling pin for actuating the coupling pin upon rotation of said shaft.

16. An adapter, as defined in claim 15, wherein said shaft extends to positions adjacent opposite sides of said adapter, means on opposite ends of said shaft engageable with a tool for enabling a workman to rotate the shaft selectively from opposite sides of the adapter.

17. An adapter, as defined in claim 14, wherein said pin means includes a vertical coupling pin centrally located on said upper adapter structure, and laterally projecting pins at opposite sides of said upper adapter structure.

18. An adapter, as defined in claim 14, wherein said means yieldably supporting said upper adapter structure is compressible for permitting the upper adapter structure to be depressed with respect to the intermediate adapter structure under the weight of a trailer supported on the adapter, and said coupling means further includes upstanding pin means fixed on the intermediate adapter structure, and engageable with a trailer when the upper adapter structure is depressed.

19. An adapter for a rail bogie for connection to a rail highway trailer having highway wheels, said adapter comprising a bottom adapter structure, an intermediate adapter structure, air bag means between said bottom adapter structure and said intermediate adapter structure for selectively raising and lowering said intermediate adapter structure, means on said intermediate adapter structure for coupling the adapter to a trailer, said means for coupling the adapter to a trailer comprising an upper adapter structure, means yieldably supporting said upper adapter structure on said intermediate adapter structure and retractable and extendable pin means on said upper adapter structure selectively for engaging a trailer, said pin means comprising a coupling pin, a shaft rotatable on said upper adapter structure, linkage between said shaft and said coupling pin for actuating the coupling pin upon rotation of the shaft, means fixed on said shaft and presenting a locking shoulder, and a retractable locking pin mountable on said upper adapter structure for engaging said locking shoulder and releasably locking said shaft when the coupling pin is in an extended trailer coupling position.

20. An adapter, as defined in claim 19, which includes a second shaft rotatably mounted on said upper adapter structure, means connecting said second shaft and said locking pin for withdrawing the locking pin from said locking shoulder upon selective rotation of said second shaft.

21. A rail bogie for connection to a rail highway trailer having highway wheels comprising a bogie frame, pairs of forward and rear rail wheels supporting said frame, a lower adapter structure pivotally mounted on said bogie frame, and including opposite end portions respectively located between the front rail wheels and the rear rail wheels, an intermediate adapter structure, including opposite side portions respectively overlying said opposite end portions of the lower adapter structure, a lift comprising air bags respectively disposed between said lower adapter structure end portions and the overlying portions of the intermediate adapter for selectively moving the intermediate adapter between a lowered position and a raised trailer supporting position, linkage interconnecting the lower and intermediate adapter structures for controlling movement of the intermediate adapter structures between said lowered and said raised positions, said linkage including first and second shaft means respectively mounted on said lower and intermediate adapter structures, and first and second links freely pivotally supported on said first and second shaft means, respectively and also pivotally connected to each other, an upper adapter structure shiftably supported by said intermediate adapter structure, and retractable coupling pin means on said upper adapter structure for coupling engagement with a trailer.

22. A rail bogie, as defined in claim 21, wherein said intermediate adapter structure includes a frame extending transversely of the bogie between said side portions, said upper adapter structure comprises a spring plank extending beneath said frame, and opposite end upper bolsters connected to the spring plank and overlying said intermediate adapter structure, said upper bolsters being engageable beneath a trailer, spring means supported on said frame and engaging and supporting said upper bolsters for enabling the upper adapter structure to be depressed relative to the intermediate adapter structure under the weight of a trailer, said retractable coupling pin means comprising a centrally located, upstanding coupling pin on said spring plank and extending through said frame for coupling engagement with a trailer.

23. A rail bogie, as defined in claim 22, which includes laterally extending coupling pins on said upper bolsters, spring means for yieldably biasing said lateral coupling pins toward extended trailer engaging positions, and air bag means for selectively retracting said lateral coupling pins.

24. A rail bogie, as defined in claim 22, which includes fixed coupling pins on said intermediate adapter structure for engaging a trailer when the upper adapter structure is depressed relative to the intermediate adapter structure.

* * * * *